United States Patent [19]

Ishi

[11] 3,983,806

[45] Oct. 5, 1976

[54] HAMMER BANK ASSEMBLY

[75] Inventor: George Ishi, Sun Valley, Calif.

[73] Assignee: Data Products Corporation, Woodland Hills, Calif.

[22] Filed: June 12, 1975

[21] Appl. No.: 586,143

Related U.S. Application Data

[63] Continuation of Ser. No. 424,340, Dec. 10, 1973, abandoned.

[52] U.S. Cl. ..... 101/93.48; 101/93.34

[51] Int. Cl.[2] ..... B41J 9/02

[58] Field of Search ..... 101/93.48, 111, 110, 101/93.28–93.36; 248/14, 226 D, 228, 232–234; 172/643

[56] References Cited

UNITED STATES PATENTS

| | | | |
|---|---|---|---|
| 1,734,408 | 11/1929 | Thompson | 172/643 |
| 2,614,268 | 10/1952 | Davies | 248/228 |
| 2,836,449 | 5/1958 | Varlonga | 248/228 X |
| 3,434,413 | 3/1969 | Lee et al. | 101/93 |
| 3,568,593 | 3/1971 | Papadopoulos | 101/93 |
| 3,636,865 | 1/1972 | Konkel et al. | 101/93 |
| 3,643,595 | 2/1972 | Helms et al. | 101/93 |
| 3,696,739 | 10/1972 | Bagland et al. | 101/93 |
| 3,714,892 | 2/1973 | Perry | 101/93 |
| 3,843,083 | 10/1974 | Angibaud | 248/226 D X |

*Primary Examiner*—Edward M. Coven
*Attorney, Agent, or Firm*—Lindenberg, Freilich, Wasserman, Rosen & Fernandez

[57] ABSTRACT

A hammer bank assembly useful in high speed, moving type, impact printers of the kind generally employed in data processing systems. The assembly is comprised of a mounting structure supporting a plurality of aligned hammer modules and a plurality of aligned magnet modules. The mounting structure includes a rigid cylindrical tube and a plurality of fastening members disposed therealong. Each hammer module includes multiple hammers resiliently mounted on a common foot member. Each hammer is comprised of an impact tip carried on a rigid coil structure. Each hammer module foot member has a recess of substantially semicircular cross section dimensioned to conform to the periphery of the rigid tube. A plurality of identical hammer modules are mounted on the rigid tube with each foot member being secured to a different fastening member and with the tube engaging each foot member in the recess thereof. Each magnet module includes multiple permanent magnets rigidly mounted on a common foot member having a recess of substantially semicircular cross section, also dimensioned to conform to the tube periphery. A plurality of magnet modules are mounted on the rigid tube with the foot members thereof secured to said fastening members and with the magnets thereof interleaved with said hammers so that each hammer coil structure is disposed in a permanent magnet field. Energization of the coil develops a force on the coil structure to propel the hammer toward the moving type surface. Each magnet module also includes multiple adjustable backstops, each for bearing against and establishing the rest position of a hammer.

13 Claims, 12 Drawing Figures

HAMMER BANK ASSEMBLY

This is a continuation of application Ser. No. 424,340, filed Dec. 10, 1973, now abandoned.

BACKGROUND OF THE INVENTION

This invention relates generally to improvements in hammer bank assemblies useful in high speed impact printers of the kind generally employed in data processing systems.

U.S. Pat. No. 3,279,362 discloses an improved hammer configuration in which a flat rigid coil structure, carrying an impact tip thereon, is supported on a pair of flexible conductive members for substantially rotational movement about a horizontal axis extending perpendicular to the plane of the coil structure. The coil is disposed in a permanent magnet field so that when energized, a force is developed on the coil structure to rotate it from a rest position to an impact position against a movable type bearing surface.

U.S. Pat. No. 3,643,595 discloses a hammer bank assembly comprised of a plurality of hammer modules mounted so as to be useful in a moving type impact printer.

SUMMARY OF THE INVENTION

The present invention is directed to an improved hammer bank assembly for inexpensively and precisely mounting a plurality of hammers in alignment and adjacent to a moving type bearing surface.

In accordance with the preferred embodiments of the invention, a hammer bank assembly is provided comprised of a mounting structure supporting a plurality of aligned hammer modules and a plurality of aligned magnet modules. The mounting structure includes at least one rigid cylindrical tubes and a plurality of fastening members disposed therealong. Each hammer module includes multiple hammers resiliently mounted on a common foot member. Each hammer is comprised of an inpact tip carried on a rigid coil structure. Each hammer module foot member has a recess of substantially semicircular cross section dimensioned to conform to the periphery of the rigid tube. A plurality of identical hammer modules are mounted on the rigid tube with each foot member being secured to a different fastening member and with the tube engaging each foot member in the recess thereof. Each magnet module includes multiple permanent magnets rigidly mounted on a common foot member, having a recess of substantially semicircular cross section also dimensioned to conform to the tube periphery. A plurality of magnet modules are mounted on the rigid tube with the foot members thereof secured to said fastening members and with the magnets thereof interleaved with said hammers so that each hammer coil structure is disposed in a permanent magnet field. Energization of the coil develops a force on the coil structure to propel the hammer towards the moving type bearing surface.

In accordance with one aspect of the invention, the mounting structure further includes a second rigid tube secured in parallel relationship with the first mentioned tube between a pair of end plates. The first and second tubes are slightly spaced and support therebetween said fastening members comprising substantially hourglass shaped inserts, having oppositely directed internally threaded bores.

In accordance with a further aspect of the invention, the foot members of the hammer and magnet modules respectively engage said first tube along substantially equal arcs displaced by substantially 180° around the circumference of the tube. The hammer module foot members are secured to said fastening inserts by bolts threaded into bores extending in one direction and the magnet module foot members are secured to the fastening inserts by bolts threaded into the oppositely directed bores.

In accordance with a still further aspect of the invention, each magnet module includes multiple adjustable backstops, each aligned with and adapted to engage a hammer to precisely establish the rest position thereof.

In a first embodiment of the invention, the mounting structure is supported for rapid reciprocal movement parallel to the elongated dimension of the tubes to thus allow each hammer to print in more than one column. In a second embodiment of the invention, the hammer bank assembly consists of two halves, inverted with respect to one another, each including a mounting structure as aforedescribed. In this second embodiment, the hammer modules of the respective halves are offset so as to interleave the hammers and enable the hammer impact tips on both halves to be presented on a common print line.

DESCRIPTION OF THE PREFERRED EMBODIMENTS

Figure 1:
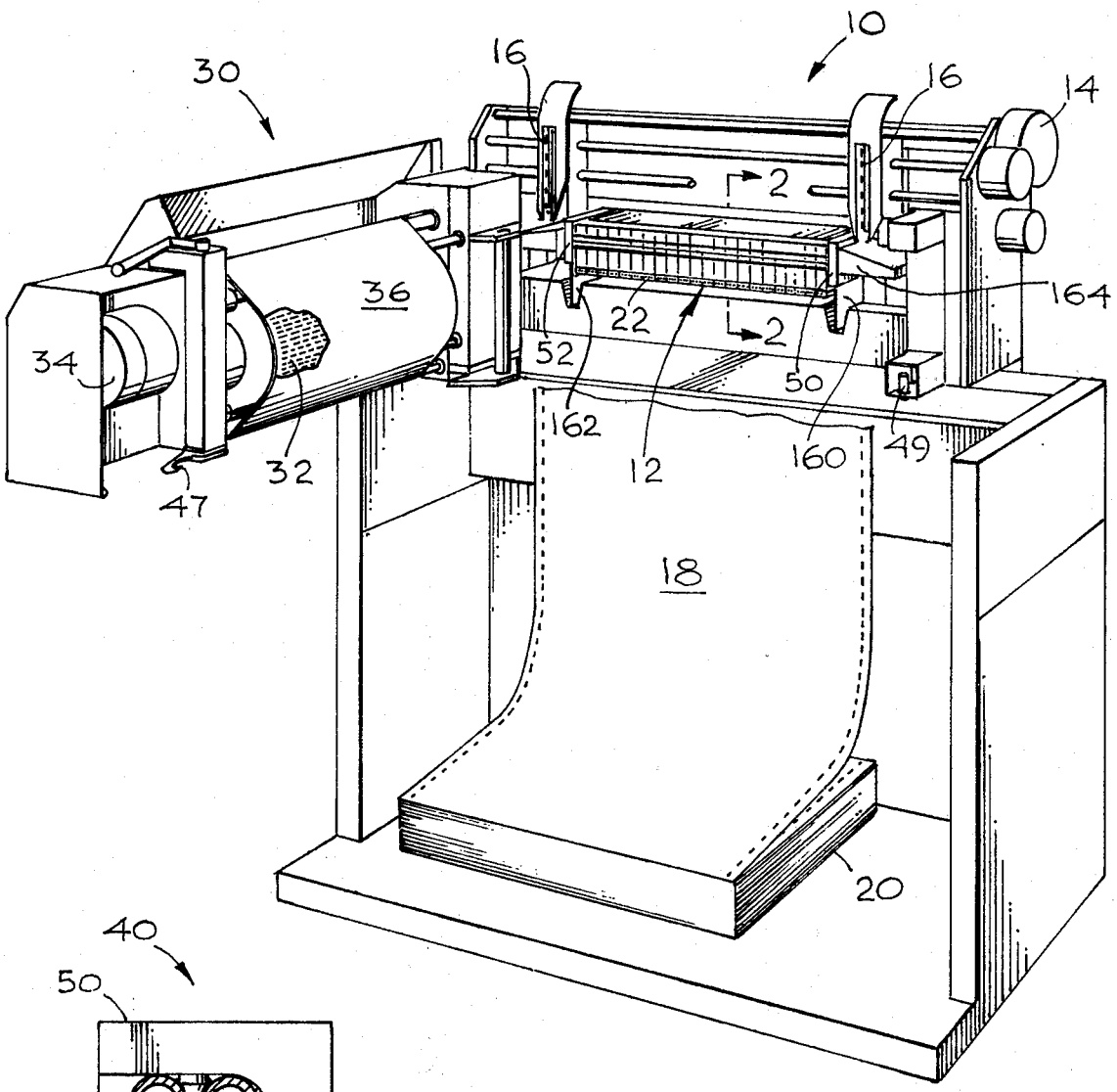
FIG. 1 is a perspective view of a high speed impact printer employing a hammer bank assembly in accordance with the present invention.
Figure 5:
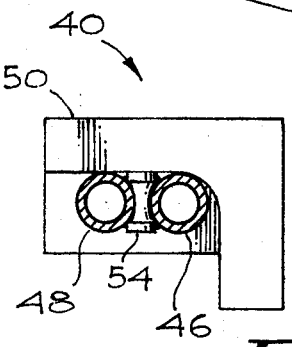
FIG. 5 is a sectional view taken substantially along the plane 5—5 of FIG. 4.
Figure 4:
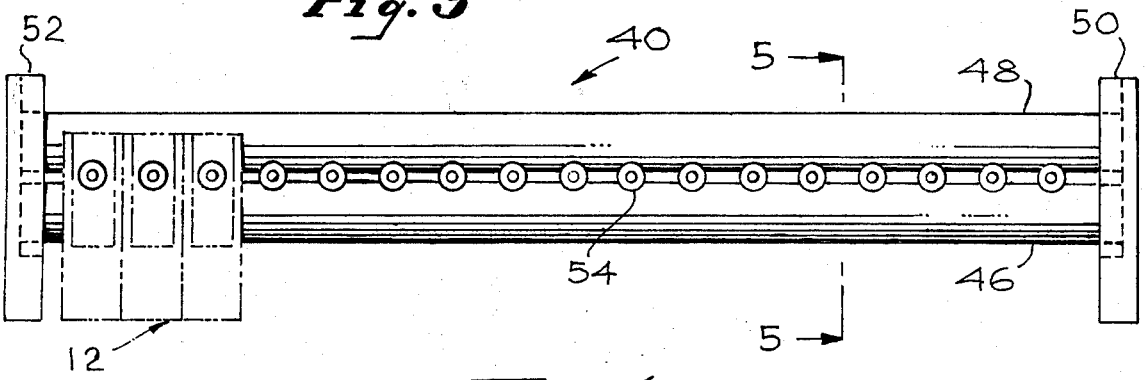
FIG. 4 is a plan view of the hammer bank assembly mounting structure.

Attention is now called to FIG. 1 which illustrates a high speed impact printer exemplary of the type generally employed for data processing applications. Briefly, the printer of FIG. 1 is comprised of a first frame 10 supporting a hammer bank assembly 12 and a paper stepping system generally comprised of motor 14 driving tractor chains 16. The chains 16 pull edge perforated paper 18 from a supply stack 20 past the hammer faces 22 of the hammer bank assembly 12. The printer of FIG. 1 also includes a second frame 30 which is hinged with respect to the frame 10. The frame 30 supports a moveable type bearing surface such as a horizontally oriented multitrack drum 32 which is rotated about its axis by a motor 34. Means are provided for passing a printing ribbon 36 between the rotating character drum 32 and the hammer faces 22.

In the operation of the printer of FIG. 1, the edge perforations of the paper 18 are engaged with the sprockets of the chains 16 to thus enable the motor 14 to pull the paper past the hammer faces 22. Normally, the motor 14 steps the paper one line at a time. Printing of course, can be accomplished only when the frame 30 is pivoted to a closed position relative to the frame 10 and locked thereto, as by cooperating latch portions 47 and 49. In this closed operative position, the hammer faces 22 will be disposed very close to the paper which in turn will be disposed very close to the printing ribbon 36. As the character drum 32 rotates, it cyclically passes different raised characters in front of each hammer face. By actuating a hammer at an appropriate time, the hammer face is propelled against the backside of the paper, forcing the paper against the ribbon 36 and drum 32 to thus print a character on the front side of the paper.

The prior art is replete with high speed impact printers of the type briefly described thus far. The present invention is directed primarily to the improved hammer bank assembly 12 illustrated in FIG. 1.

Figure 2:
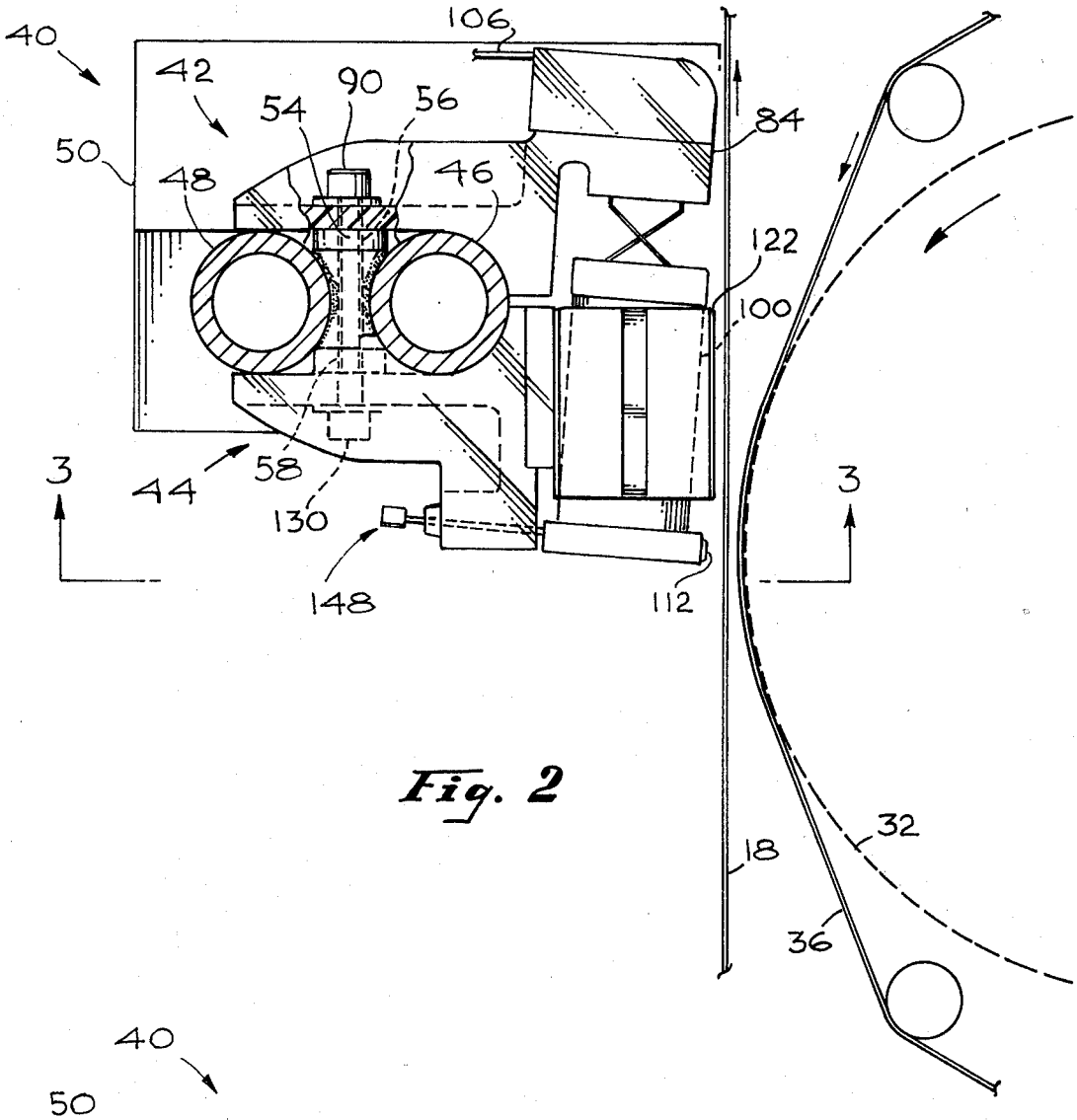
FIG. 2 is a sectional view taken substantially along the plane 2—2 of FIG. 1.
Figure 3:
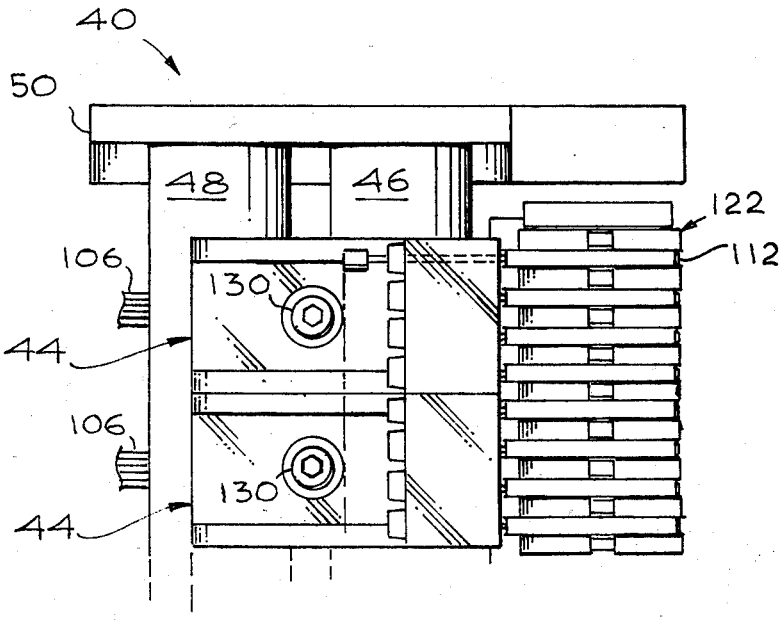
FIG. 3 is a sectional view taken substantially along the plane 3—3 of FIG. 2.

Attention is now called to FIGS. 2 and 3 which respectively illustrate a side sectional view and bottom plan view of a hammer bank assembly 12 in accordance with the present invention.

The hammer bank assembly 12 is comprised of a mounting structure 40 and a plurality of hammer modules 42 and magnet modules 44 supported on the mounting structure. More particularly, the mounting structure 40 is generally comprised of first and second elongated tubular members 46 and 48 which are secured in parallel relationship between a pair of end plates 50 and 52. The mounting structure 40 additionally includes a plurality of fastening members 54 which are disposed along the length of the tubes 46 and 48. More particularly, each fastening member 54 constitutes a substantially hour-glass shape insert for fitting between the members 46 and 48 and substantially engaging the circumferential surfaces thereof. The fastening members 54 are secured to the elongated members 46 and 48 by an appropriate means, such as by epoxy. Each fastening member 54 includes oppositely extending bores 56 and 58 therein which are internally threaded for receiving bolts for fastening hammer and magnet modules thereto. This will be discussed in greater detail hereinafter.

Figure 6A:
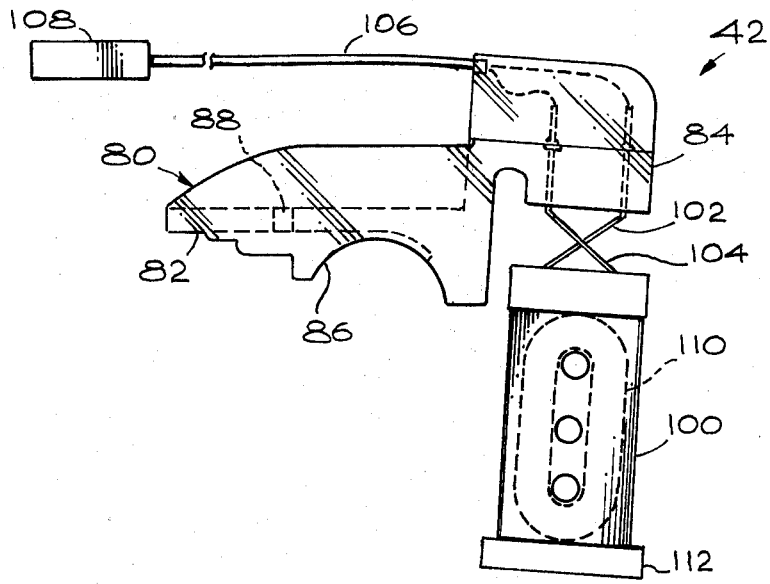
FIGS. 6A and 6B are respectively side and front views of a hammer module.

Each hammer module 42 is comprised of a common foot member 80, best illustrated in FIG. 6A, which generally includes a rear base portion 82 for locating and securing the module to the mounting structure elongated member 48 and a forwardly projecting hammer support portion 84.

The rear base portion 82 of the foot member 80 includes a recess 86 of semicircular cross-section dimensioned so as to conform to the outer circumference of the mounting structure elongated member 46. The hammer module foot member 80 is provided with a bolt hole 88 extending therethrough for receiving a bolt 90 (FIG. 2) which threads into the internally threaded bore 56 of a fastening member 54.

Figure 6B:
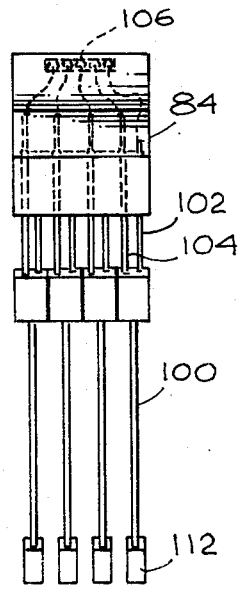

Each of the hammer modules 42 further includes a multiple number of hammers (e.g. four hammers per module as depicted in FIG. 6B), each hammer being spring-mounted on the forwardly projecting portion 84 of foot member 80. As is disclosed in the aforementioned U.S. Pat. No. 3,279,362 each of the hammers is comprised of a rigid coil structure 100 mounted for rotation on a pair of conductive springs 102 and 104. The ends of the springs 102 and 104 remote from the coil structure 100 are secured in the portion 84 of the foot member 80. The springs 102 and 104 are electrically conductive for carrying current to the coil in the coil structure 100. A multiwire cable 106 is provided for coupling a connector 108 to the multiple hammers of each hammer module. The coil structure 100 is generally comprised of a multiturn conductor coil 110 disposed within a flat rigid housing, of aluminum, for example. The ends of the coil 110 are electrically connected to the springs 102 and 104. An impact tip 112 is carried on the end of the rigid coil structure 100 remote from the springs 102 and 104.

The plurality of hammer modules are mounted on the elongated member 46 in alignment, positioned by the engagement of the member 46 within the semicircular recesses in the hammer module foot members and by the engagement of the bolts 90 extending through the hammer module foot members into the fastening members 54. Positioned in this manner, the front ends of all the impact tips 112 lie along a common horizontal line extending parallel to the axis of the character drum 32 of FIG. 1.

Figure 7A:
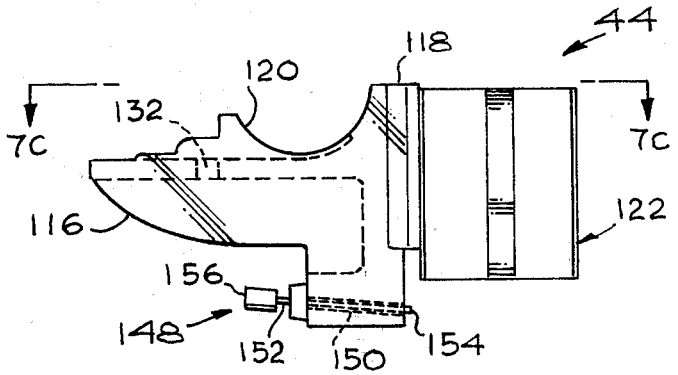
FIGS. 7A and 7B are respectively side and front views of a magnet module.
Figure 7B:
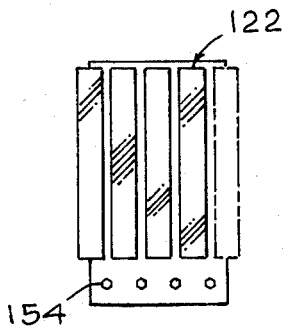

In order to develop the propelling force on the coil structure 100 of a hammer module, to thus impact the hammer tip against the drum when the coil is energized, a magnetic field is developed extending perpendicular to the planes of the coil structures. More particularly, in order to develop the nagnetic field extending perpendicular to the planes of the coil structures, a plurality of magnet modules 44 are provided. Each magnet module (FIG. 7A) is comprised of a foot member 116 and a magnet support member 118. The foot member 116 includes a recess 120 of semicircular cross section dimensioned so as to conform to the circumferential surface of the tubular member 46. Projecting forwardly from the magnet support member 118 are a plurality of spaced parallel permanent magnet slabs 122. Each permanent magnet slab consists of a first permanent magnet 124 supported adjacent to the foot member 116 and a second permanent magnet 126 secured to the first permanent magnet 124 by nonmagnetic material 128.

The magnet module foot members are all mounted on the tubular member 46 and secured with respect thereto by bolts 130 which extend through bolt holes 132 in the magnet module foot members 116. The bolts 130 are threaded into the internally threaded bores 58 within the fastening members 54.

Figure 7C:
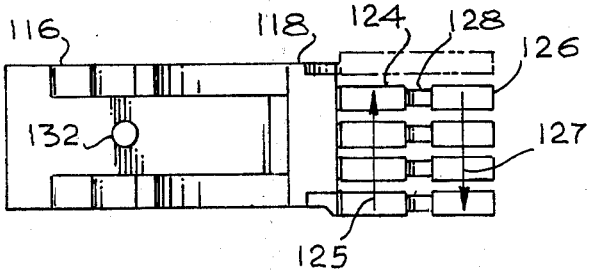
FIG. 7C is a sectional view taken substantially along the plane 7C—7C of FIG. 7A.

The magnet modules 44 and the hammer modules 42 engage the tubular member 46 along substantially equal arcs displaced from each other by approximately 180°. The respective magnet and hammer modules are secured along the tubular member 46 so that the magnet slabs 122 and coil structures 100 are interleaved. All of the magnet pieces 124 act together to create a magnet field extending in one direction perpendicular to the plane of the coil structure as represented by arrow 125 in FIG. 7C and all of the magnet pieces 126 act in concert to create a field extending in the opposite direction as represented by arrow 127. As a consequence of the permanent magnetic field established by the magnet pieces, energization of the coil winding 110 will develop a force in the plane of the coil structure 100 in a direction substantially perpendicular to the axis of the character drum 32 of FIG. 1. As a consequence, the coil structure will essentially rotate about the intersection of springs 102 and 104 to impact the hammer tip 112 against the drum to thus print a character on the front surface of the paper in the manner previously set forth.

It should be recognized that if high quality printing, in which all of the characters are printed in alignment, is to be achieved using a continually rotating drum, it is essential that all of the hammers have a precise rest position with respect to the drum and that they be precisely fired to impact against the drum when the drum is in the appropriate position. Precision vertical and horizontal location of the hammers is assured by the previously discussed cooperation between the shape of the hammer module foot member and the elongated mounting bar 46. Precision time energization of the coils is achieved by well known electronic circuitry. Still, it is essential that the rest position of each hammer be precisely established in order for high quality printing to be achieved. To achieve this, adjustable backstops 148 are provided in the magnet modules to establish a precise rest position for each hammer. Adjustability is required to compensate for various factors which might effect the desired hammer rest position. For example, as the hammer impact tip continually rebounds from the drum against the backstop, the backstop will wear and thus it is normally necessary to periodically adjust the backstop position in order to maintain the desired rest position of the hammers. Adjustability of the backstop can also compensate for other factors such as minor variations between magnetic fields from one gap to another.

More particularly, in accordance with the present invention, each magnet module 44 is provided with a plurality of bores 150, each aligned with a hammer impact tip 112 when the hammer and magnet modules are operatively mounted on the mounting tube 46. The bore 150 is internally threaded and receives therein an externally threaded backstop bolt 152 which projects through the magnet module foot member and extends into engagement with the impact tip 112 at its forward end 154. The rear end 156 of the backstop bolt 152 is accessible so that the bolt can be turned to thread it through the magnet module foot member bore. Thus, it should be apparent that by adjusting a backstop bolt, the rest position of the hammer in contact therewith can be precisely established.

In accordance with the preferred embodiment of the invention, as depicted in FIG. 1, the entire mounting structure i.e., comprised of members 46 and 48 and end plates 50 and 52, is mounted for rapid reciprocal movement parallel to the elongated direction of the members 46 and 48. More particularly, the end plates 50 and 52 are respectively supported on flex pivots 160 and 162. The flex pivots each comprise a piece of flexible resilient metal anchored at their lower ends to the printer frame 10. The upper ends of the flex pivots are affixed to the end plates 50 and 52. The moveable actuator 164 of a linear motor (not shown) is secured to the end plate 50 to thereby drive the hammer assembly linearly parallel to the elongation of the mounting structure tubular elements 46 and 48. By moving the hammer assembly in this manner, each hammer impact tip can be aligned with either of two character columns on the printer 32. Accordingly, for a printing apparatus of the type depicted in FIG. 1 for printing 132 columns of characters, it is only necessary that 66 hammers be provided.

Figure 8:
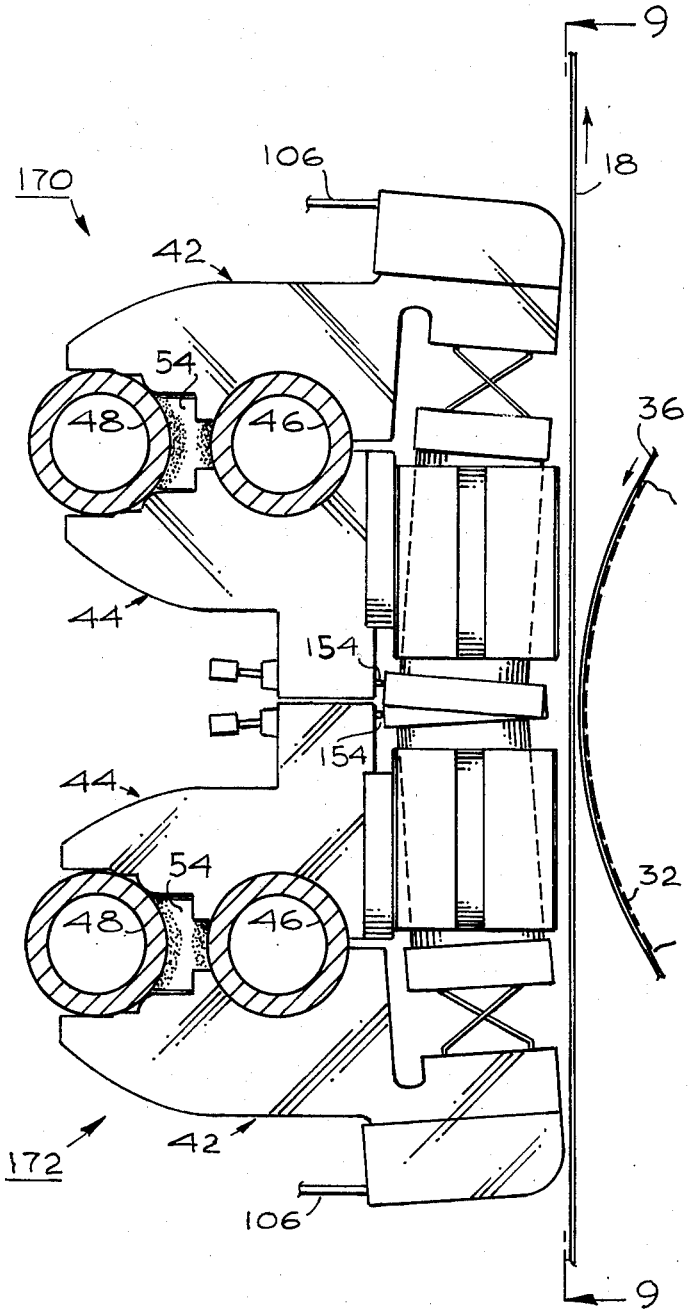
FIG. 8 is a sectional view, similar to the sectional view shown in FIG. 2, but illustrating an alternative embodiment of the invention.
Figure 9:
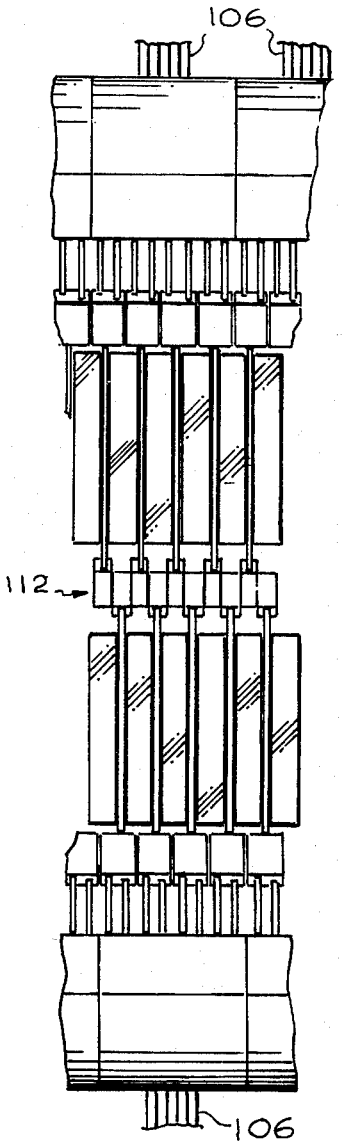
FIG. 9 is a sectional view taken substantially along the plane 9—9 of FIG. 8.

An alternative arrangement of the invention is represented in FIGS. 8 and 9 in which the hammer bank assembly is fixedly mounted rather than being mounted for reciprocal linear movement. As shown in FIG. 8, the assembly is comprised of two halves 170 and 172 inverted with respect to one another so that the impact tips carried by the hammers are interleaved and aligned along a common print row. The configuration of FIG. 8 would require a number of hammers equal to the number of columns to be printed.

From the foregoing, it should now be apparent that a hammer bank assembly has been disclosed herein which, due to its simplicity, can be inexpensively fabricated and yet which assures easy and precise positioning of hammers and magnets relative to one another. Precision positioning of the hammer and magnet modules is achieved as a consequence of mounting all the modules on a common elongated mounting member which bears against the foot member of each of the modules in a precise recess thereof, shaped and dimensioned to conform to the periphery of the elongated mounting member.

The embodiments of the invention in which an exclusive property or privilege is claimed are defined as follows:

1. A hammer bank assembly useful in high speed impact printers, said assembly comprising:

mounting means including a first elongated member of substantially uniform cross section;

a plurality of fastening members affixed along said elongated member;

a plurality of hammer modules, each including a foot member and a hammer supported on said foot member for movement with respect thereto, each of said hammer module foot members defining an open recess therein of a shape and dimension conforming to a portion of the cross sectional periphery of said elongated member;

a plurality of magnet modules, each including a foot member and a magnet member supported on said foot member, each of said magnet module foot members defining an open recess therein of a shape and dimension conforming to a portion of the cross sectional periphery of said elongated member;

means fixedly securing each of said plurality of hammer modules to a different one of said fastening members at a different position along said elongated member with said portion of the cross-sectional periphery of said elongated member engaging said hammer module foot members in the recesses thereof; and means fixedly securing each of said plurality of magnet modules to a different one of said fastening members at a different position along said elongated member with said portion of the cross-sectional periphery of said elongated member engaging said magnet module foot members in the recesses thereof and with said magnet members interleaved with said hammers.

2. The assembly of claim 1 wherein said elongated member is cylindrical and wherein said hammer module and magnet module recesses are of semicircular cross section.

3. The assembly of claim 1 wherein each of said fastening members includes first and second oppositely directed internally threaded bores; and wherein said means securing said hammer modules includes bolts extending through each of said hammer module foot members and threaded into said first bores in said fastening members; and wherein said means securing said magnet modules includes bolts extending through each of magnet module foot members and threaded into said second bores in said fastening members.

4. The assembly of claim 1 wherein each of said hammer modules includes multiple hammers supported on a common foot member in spaced parallel relationship.

5. The assembly of claim 4 wherein each of said hammers includes a flat rigid coil structure;

an impact tip carried by said rigid coil structure; and a pair of electrically conductive spring members secured to said coil structure and said foot member for supporting said coil structure for movement with respect to said foot member.

6. The assembly of claim 1 wherein each of said magnet modules includes an adjustable backstop means for bearing against and establishing the rest position of a hammer.

7. The assembly of claim 1 wherein each of said magnet modules includes multiple magnet members supported on a common foot member in spaced parallel relationship.

8. The assembly of claim 1 wherein each of said magnet members includes a first permanent magnet secured to said foot member and a second permanent magnet secured to said first permanent magnet by non-magnetic material.

9. An impact printer including:

1. a movable type-bearing surface;
2. a hammer bank assembly mounted adjacent to said type bearing surface, said assembly comprising:
   a. mounting means including a first elongated member of substantially uniform cross section;
   b. a plurality of fastening members affixed along said elongated member;
   c. a plurality of hammer modules, each including a foot member and a hammer supported on said foot member for movement with respect thereto, each of said hammer module foot members defining an open recess therein of a shape and dimension conforming to a portion of the cross-sectional periphery of said elongated member;
   d. a plurality of magnet modules, each including a foot member and a magnet member supported on said foot member, each of said magnet module foot members defining an open recess therein of a shape and dimension conforming to a portion of the cross-sectional periphery of said elongated member;
   e. means fixedly securing each of said plurality of hammer modules to a different one of said fastening members at a different position along said elongated member with said portion of said cross-sectional periphery of said elongated member engaging said hammer module foot members in the recesses thereof; and
   f. means fixedly securing each of said plurality of magnet modules to said elongated member at a different position along said elongated member with said portion of said cross-sectional periphery of said elongated member engaging said magnet module foot members in the recesses thereof and with said magnet members interleaved with said hammers; and
3. means for moving paper between said type bearing surface and said hammer bank assembly.

10. The impact printer of claim 9 wherein said elongated member is cylindrical and wherein said hammer module and magnet module recesses are of semicircular cross section.

11. The impact printer of claim 9 wherein each of said fastening members includes first and second oppositely directed internally threaded bores; and wherein said means securing said hammer modules includes bolts extending through each of said hammer module foot members and threaded into said first bores in said fastening members; and wherein said means securing said magnet modules includes bolts extending through each of magnet module foot members and threaded into said second bores in said fastening members.

12. The impact printer of claim 9 including a second elongated member and wherein each of said first and second elongated members comprises a hollow tube; and means supporting said first and second elongated members in spaced parallel relationship.

13. The impact printer of claim 12 wherein each of said fastening members has an external periphery shaped to conform to a portion of the peripheral cross section of said first and second elongated members; and means supporting each fastening member between said spaced parallel elongated members and in engagement therewith with said fastening members being distributed along the length of said elongated members.

* * * * *

UNITED STATES PATENT OFFICE

CERTIFICATE OF CORRECTION

Patent No. 3,983,806 Dated October 5, 1976

Inventor(s) GEORGE ISHII

It is certified that error appears in the above-identified patent and that said Letters Patent are hereby corrected as shown below:

Change the spelling of the Inventor's name from "Ishi" to --Ishii--.

Signed and Sealed this

Fourth Day of January 1977

[SEAL]

*Attest:*

RUTH C. MASON
*Attesting Officer*

C. MARSHALL DANN
*Commissioner of Patents and Trademarks*